US005543038A

United States Patent [19]

Johannessen

[11] Patent Number: 5,543,038

[45] Date of Patent: Aug. 6, 1996

[54] DISTRIBUTING AND REGULATING UNIT

[76] Inventor: Jørgen M. Johannessen, 6 Aspevej, Strøby Egede, DK-4600 Køge, Denmark

[21] Appl. No.: 448,559

[22] PCT Filed: Jan. 10, 1994

[86] PCT No.: PCT/DK94/00017

§ 371 Date: Jun. 7, 1995

§ 102(e) Date: Jun. 7, 1995

[87] PCT Pub. No.: WO94/16159

PCT Pub. Date: Jul. 21, 1994

[30] Foreign Application Priority Data

Jan. 11, 1993 [DK] Denmark ..... 0023/93

[51] Int. Cl.[6] ..... E03F 5/14

[52] U.S. Cl. ..... 210/417; 210/154; 210/162; 210/242.1; 210/248

[58] Field of Search ..... 210/117, 154, 210/162, 242.1, 248, 257.1, 435, 446

[56] References Cited

U.S. PATENT DOCUMENTS

| | | | |
|---|---|---|---|
| 1,093,994 | 4/1914 | Kaibel . | |
| 2,673,451 | 3/1954 | Gariel | 210/154 |
| 2,782,929 | 8/1954 | Colket . | |
| 3,221,889 | 12/1965 | Hirsch | 210/519 |
| 3,687,298 | 8/1972 | Rozkydalek | 210/519 |
| 3,815,742 | 6/1974 | Dubouchet | 210/154 |
| 3,899,427 | 8/1975 | Connelly . | |
| 4,056,477 | 11/1977 | Ravitts . | |
| 4,122,016 | 10/1978 | Tao et al. . | |
| 4,123,365 | 10/1978 | Middlebeek . | |
| 4,202,778 | 5/1980 | Middelbeek | 210/522 |
| 4,447,321 | 5/1984 | Jackson | 210/117 |
| 4,578,188 | 3/1986 | Cousino . | |
| 4,975,205 | 12/1990 | Sloan | 210/248 |
| 5,004,534 | 4/1991 | Buzzelli | 210/521 |
| 5,378,376 | 1/1995 | Zenner | 210/242.1 |
| 5,435,910 | 7/1995 | Verret | 210/257.1 |

FOREIGN PATENT DOCUMENTS

| | | |
|---|---|---|
| 2743580A1 | 3/1979 | Germany . |
| 9100473 | 11/1992 | Netherlands . |

OTHER PUBLICATIONS

Dutch product information sheet of Aug. 1992.

*Primary Examiner*—Peter A. Hruskoci
*Assistant Examiner*—Theodore M. Green
*Attorney, Agent, or Firm*—Browdy and Neimark

[57] ABSTRACT

A hydraulic distribution and control unit has a chamber with an inlet (1*a*) and at least two subchambers. A partition wall (5) separates the subchambers one from another. One edge of the partition wall crosses the inlet to the main chamber, dividing the inlet into layers at different levels. The uppermost subchamber has an overfall edge (4*a*) and the lowermost subchamber includes an underflow (8).

12 Claims, 6 Drawing Sheets

DISTRIBUTING AND REGULATING UNIT

FIELD OF THE INVENTION

The present invention relates to a distribution and control unit comprising a delivery pipe discharging into a chamber with one or more underflows and overflows.

BACKGROUND OF THE INVENTION

In joint drainage systems, in which sewage and rain water are discharged into the same sewer, concentrators are used in order to avoid hydraulic overloading of the purifying plant in case of heavy rain and subsequently big amounts of water in the sewer. The simplest, but also the least effective concentrator, is an overfall construction. Such a construction comprises a reservoir with an outlet, an overfall edge and a delivery pipe, normally with a comparatively big cross-section, because it has to be dimensioned for peak loads. Therefore, the flow rate in the delivery pipe will typically be relatively small and suspended matter will sink towards the bottom of the pipe. Immediately before the overfall construction, the concentration of suspended matter will therefore normally be higher at the bottom than at the top. This effect decreases with increasing flow rate and on account of turbulence. No requirements are made today in overfall constructions with respect to how the delivery is to take place, and a problem is that the turbulence from the overfall edge may be so heavy that the amount of water flowing over the overfall edge may be nearly just as polluted as the amount of water let out through the cutoff outlet to the purifying plant.

Among those skilled in the art there is a general agreement that it serves no purpose to arrange bigger reservoir volumes in joint sewage systems to limit the amount of impurities delivered to the receiver. Thus, measurements have shown that the amount of suspended matter in the water supplied to the receiver is by and large the same irrespective of whether it is supplied through overflow or through a purifying plant which has been peak loaded for a long time, because a purifying plant with a protracted peak load or momentary peak load loses its effect due to the fact that the active sludge is washed away.

SUMMARY OF THE INVENTION

It is therefore the object of the invention to provide a distribution and control unit which is cheap in relation to its effect and which ensures that the biggest possible amount of suspended matter is guided to the purifying plant with the smallest possible amount of water, whereby the variation of the amount of impurities and in particular of the amount of water becomes as little as possible.

This object is met by the invention by means of a distribution and control unit, in which at least one partition wall is provided in an inlet chamber for dividing the inlet in at least two layers and a corresponding division of the chamber into at least two levels, the lower one of which is connected with the underflow and the upper one is connected with the overfall edge. Hereby is achieved that the sewage in the inlet is divided into at least a lower part with a high concentration of suspended matter and an upper part with low concentration of suspended matter, and this division takes place in a place, which only to a slight extent, if at all, is reached by the mixing effect of the turbulence from the overfall edge.

The concentration of suspended matter in the delivery pipe will typically vary over the cross section in such a way that concentrations in the middle of the cross section at a predetermined level is higher than at the sides, or, in other words: the concentration level has a concave profile which is highest in the middle. It may, therefore, be advantageous to construct the partition wall or the partition walls in such a way that the edge which divides the inlet, curves downwardly and is highest in the middle to correspond to the profile of the concentration level.

The distribution and control unit, or short: the control unit, according to the invention may have inlets from a tributary in form of a delivery pipe, possibly an oversize one, or alternatively in form of a duct or a reservoir. The inlet opening to the lowest level of the chamber may be adapted to correspond to the capacity of the outlet. The outlet is preferably provided with a hydraulic brake, for instance a vortex brake, to avoid overloading of the succeeding part of the sewage system.

When the control unit is functioning, i.e. when so big amounts of water are delivered that an overfall takes place, the concentration of suspended matter along the bottom run in the delivery pipe, duct or reservoir will ensure that this matter is discharged through the underflow to the purifying plant. In case of particularly big amounts of water the effect of this concentration is, however, reduced on account of turbulence due to the flow rate in the delivery pipe, and to remedy this, different embodiments of the invention have been provided.

According to such an embodiment there is from the upper level but one of the chamber a connection to an overflow with an overflow edge for instance at the same height as the overfall edge, and the overflow may be connected with the outlet downstream of a possible vortex brake. Alternatively, the overflow discharges into a reservoir, from where it may completely or partially return through a non-return valve, which is connected with the first chamber below the first level. Hereby is achieved that the water flowing over the overflow edge is stored in a reservoir with a view, at a later stage, when the loading is less, to be taken to the purifying plant or, at a higher degree of filling, to be partially discharged into the receiver. The overflow may be placed inside the first chamber or a pipe may lead from the level in question of the first chamber to the overflow, which is then placed outside the first chamber.

In an embodiment, in which the delivery to the overfall construction takes place through a delivery pipe, the cross section of this pipe extends at the inlet up and above the cross section of the inlet. Hereby is achieved that impurities floating on top of the water are retained instead of running to the overfall edge.

According to yet another embodiment a siphon device is provided at the overfall edge, whereby the upper level of the chamber is emptied at least partially after the functioning of the overfall. The discharge side of the siphon device may be connected to an outlet, and in that case the inlets of the siphon device may be provided at the upper part of the delivery pipe at the inlet to the first chamber. The siphon device will then collect the light impurities floating at the top of the inlet.

The latter utilization of a siphon device may, in particular in connection with big plants, advantageously be used in connection with an embodiment, according to which a containment boom is provided at the inlet, said boom extending transversely to the width of the inlet and being adapted to follow the water level in the inlet, and a hold preventing the lower edge of the containment boom from being lifted to the upper edge of the inlet. Hereby is achieved that light impurities such as oil may be collected separately instead of being guided to the outlet.

The siphon device may comprise several individual siphons in different levels and with limited capacities. The effect of the delivery pipe as concentrator increases with increasing damming in the chamber and consequently backwards in the inlet. It may, therefore, be advantageous by means of the siphon device to successively lead increasing amounts of completely clear or partially clear water away from the chamber, before the overfall itself starts functioning, either to the receiver or to a reservoir.

In a further embodiment another partition wall is provided for dividing the lower part of the inlet into two levels, the lower one of which is connected with the underflow and the upper one with the overflow or a reservoir.

BRIEF DESCRIPTION OF THE DRAWINGS FIGURES

The invention will be explained in the following by means of embodiments with reference to the drawing, in which FIG. 1 shows a vertical section through an overfall construction with a control unit according to the invention, FIG. 2 a view of the plant according to FIG. 1 seen from above, FIG. 3 a plant with another embodiment of the control unit seen in a vertical section, FIG. 4 the plant according to FIG. 3 seen from above, FIG. 5 a plant with a third embodiment of the control unit seen in a vertical section.

FIG. 6 a vertical section through another reservoir comprising an overflow from an underlying level of the chamber of the control unit, FIG. 7 a plant with a fourth embodiment of the control unit according to the invention in a vertical section, FIG. 8 the plant according to FIG. 7 seen from above, FIGS. 9–12 shows a fifth embodiment of the control unit according to the invention, in a longitudinal view, a cross-sectional view, in a top view, and in a horizontal sectional view, respectively, FIG. 13 shows the fifth embodiment with a containment boom in the inlet, and FIGS. 14–16 show details in the containment boom according to FIG. 13, in a front view seen from the chamber of the control unit, in a vertical sectional view, and in a horizontal sectional view, respectively.

DETAILED DESCRIPTION OF THE PREFERRED EMBODIMENTS

Figure 1:
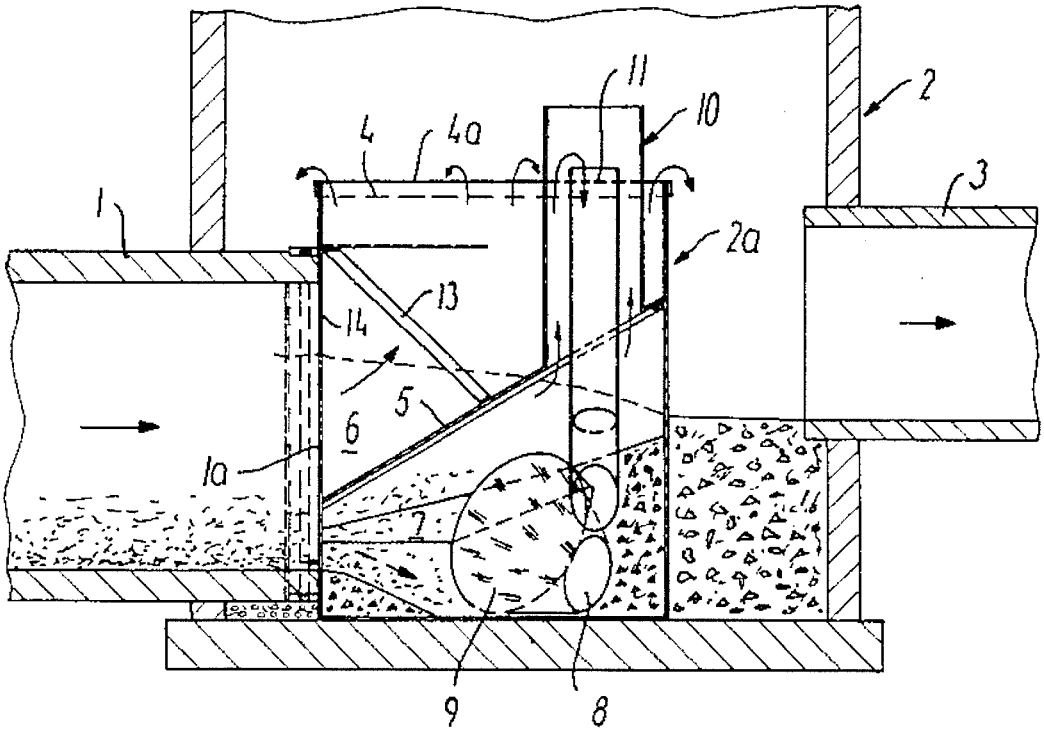
Figure 2:
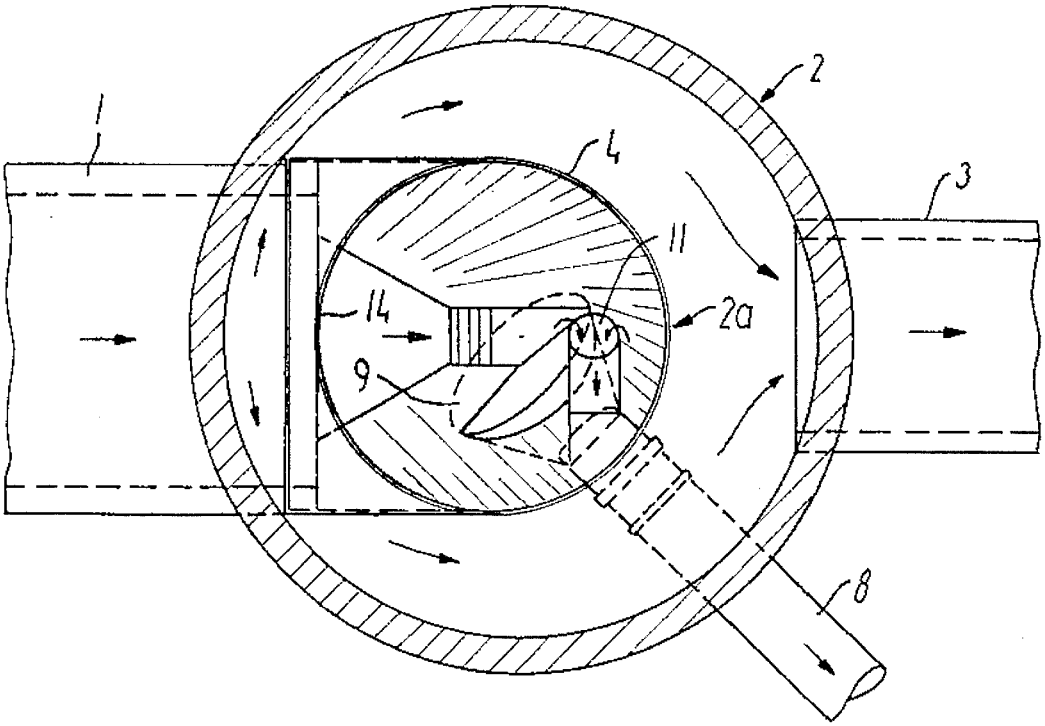

The drawing shows a delivery pipe 1 with an inlet 1*a* to an overfall plant 2 with a distribution and control unit 2*a* and an overflow pipe 3. In the control unit 2*a* a chamber 4 is arranged, said chamber being connected with the delivery pipe 1 and having an overfall edge 4*a* and a partition wall 5, which forms an overflow chamber 6 and an underflow chamber 7. The overflow chamber 6 is also referred to herein as a subchamber of the main chamber 4, more particularly as the uppermost subchamber; while the underflow chamber 7 is likewise alternatively designated as a lowermost subchamber here, and in the following claims. From the underflow chamber 7 an outlet in form of a cutoff pipe 8 is leading, which at its inlet may be provided with a hydraulic brake or controlling device 9. On the upper side of the partition wall 5 a bigger ascension pipe 10 is arranged according to the embodiment shown in FIG. 1, said pipe enclosing a smaller under/overflow pipe 11 connected with the cutoff pipe 8. On the upper side of the partition wall 5 a grate 13 is mounted, and the back wall of the chamber 4 is prolonged downwardly to form a foam screen 14 at the inlet 1*a*.

What is termed "overfall" in the present invention as seen in FIG. 1 leaves from the uppermost subchamber; while that termed overflow leaves from the lowermost chamber.

Figure 3:
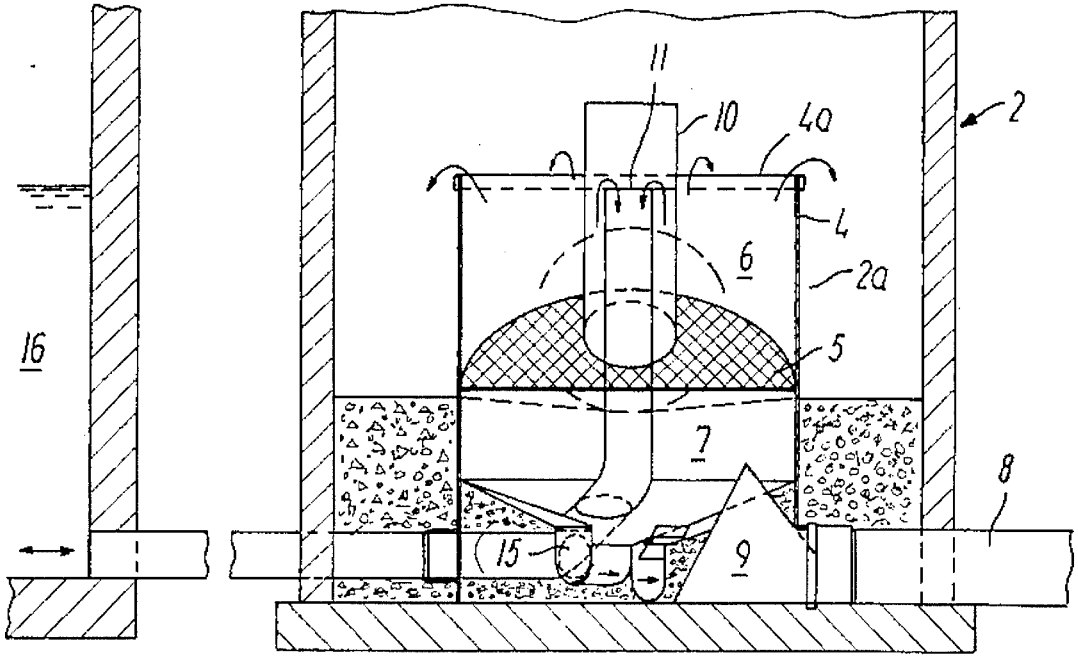
Figure 4:
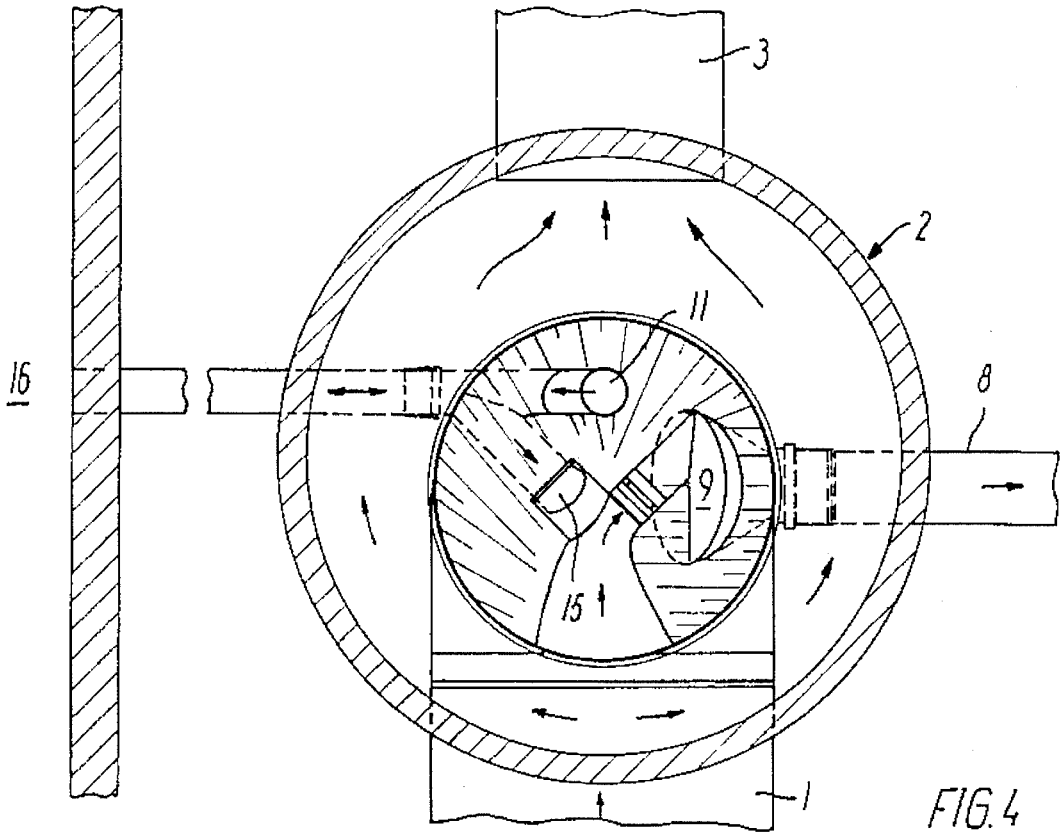

In the embodiment according to FIGS. 3 and 4 the under-overflow pipe 11 is provided with outlets to an adjacent reservoir 16, from which collected impure water may return completely or partially through a non-return valve 15 to the underflow.

Figure 5:
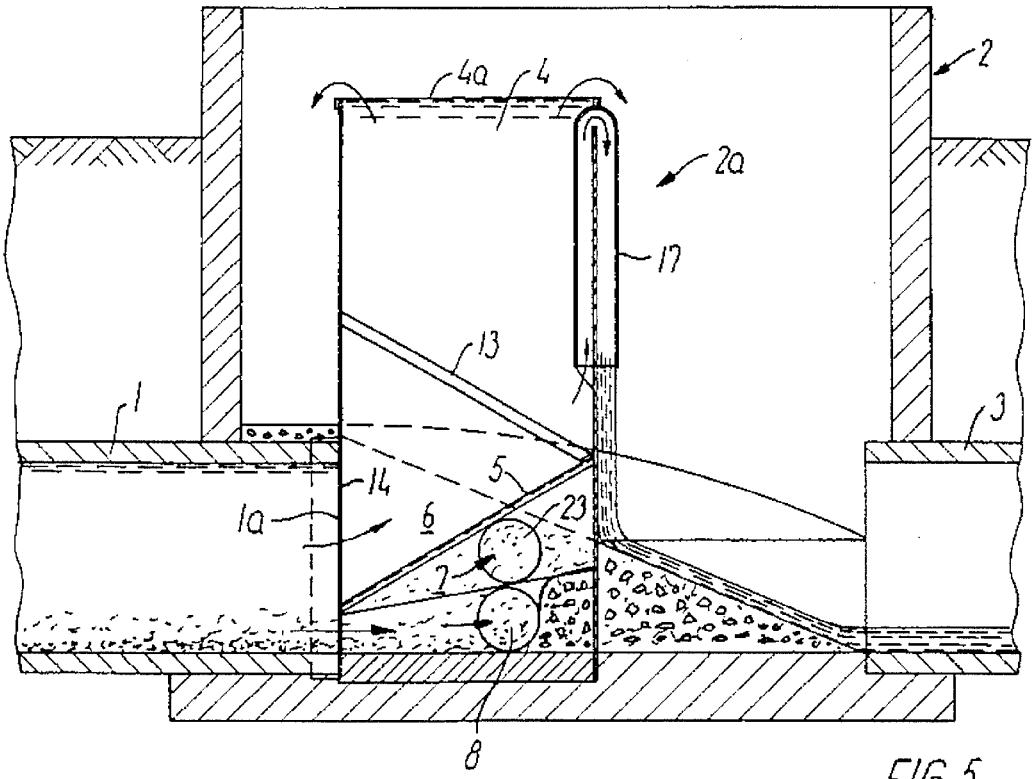
Figure 6:
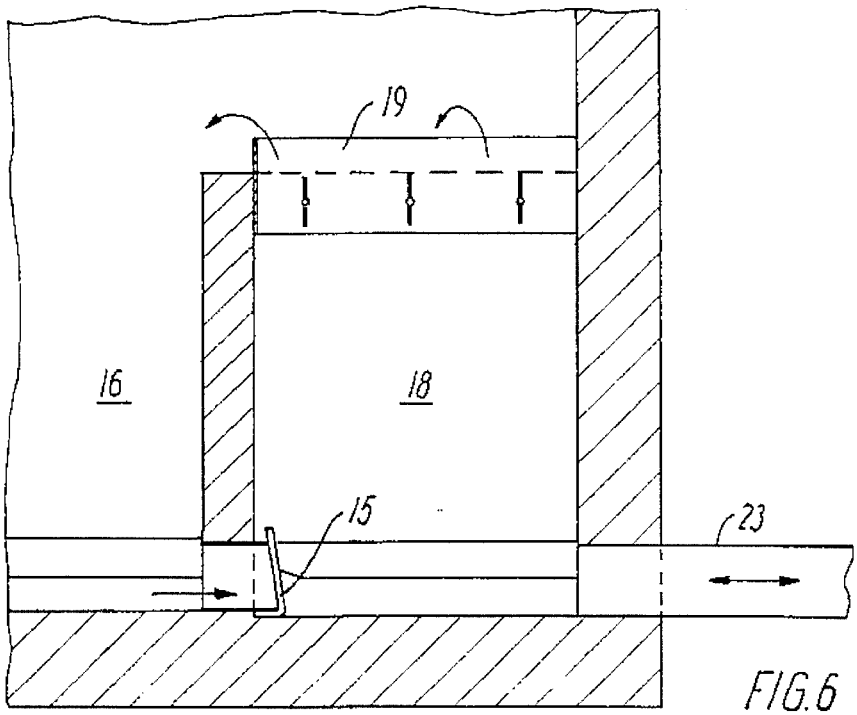

In the embodiment shown in FIG. 5 the ascension pipe 10 has been replaced by an under-overflow pipe 23, which discharges into the adjacent reservoir 16. The reservoir is shown in FIG. 6 and comprises a prechamber 18 with a height-wise adjustable overflow edge 19 and a non-return valve 15, through which the collected impure water may return completely or partially to the underflow. In the embodiment according to FIG. 5 a siphon system 17 is also provided.

Figure 7:
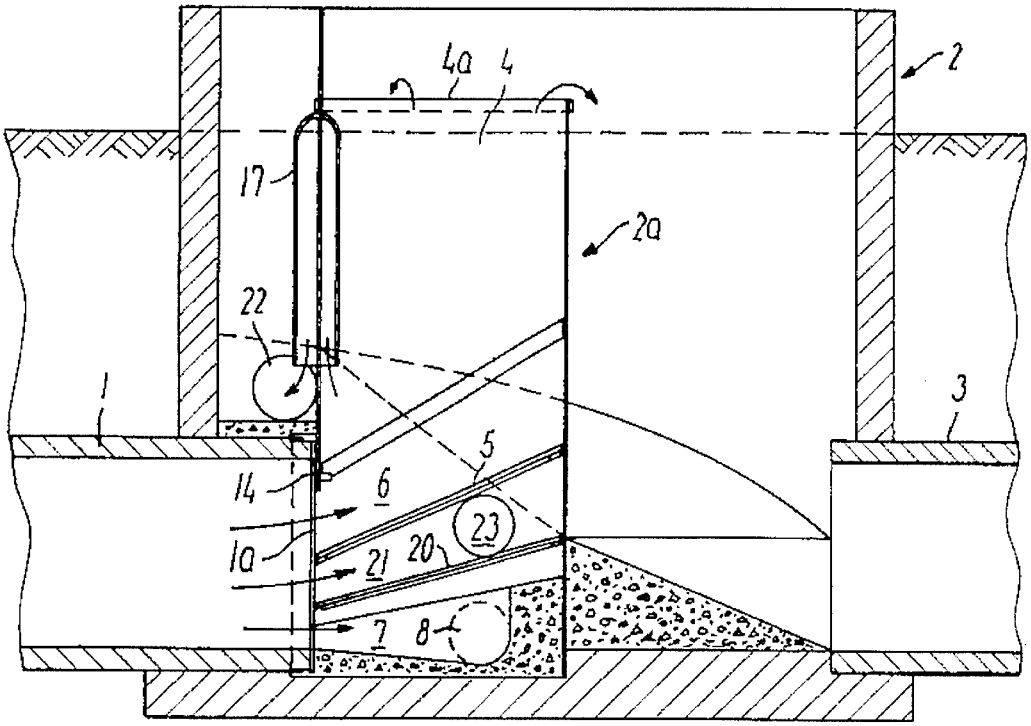
Figure 8:
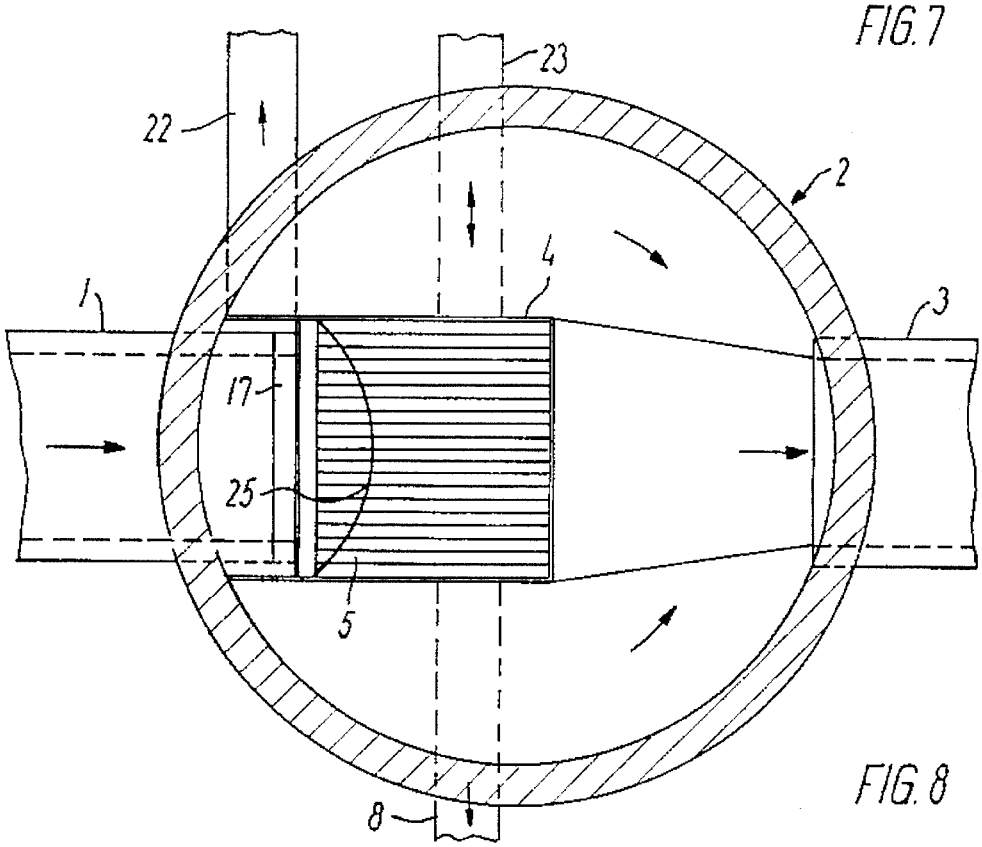
Figure 10:
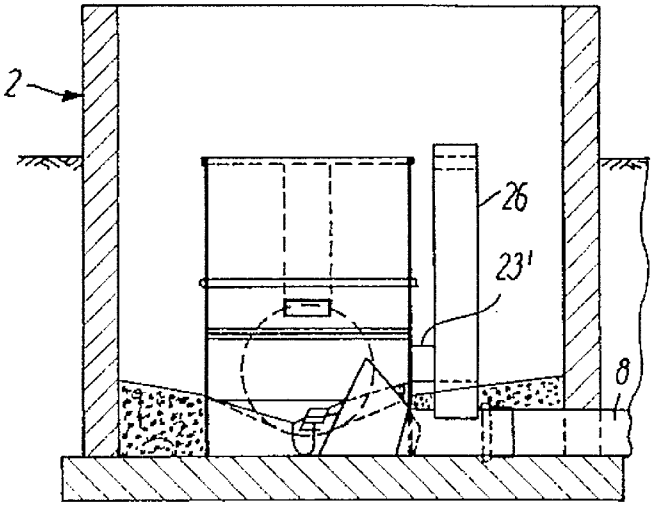
Figure 12:
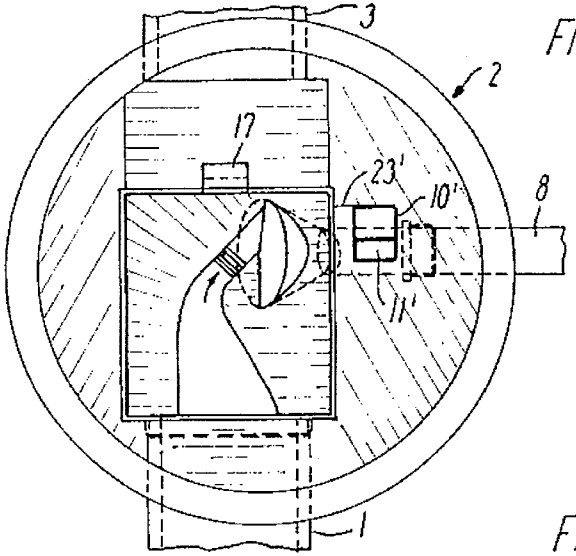
Figure 9:
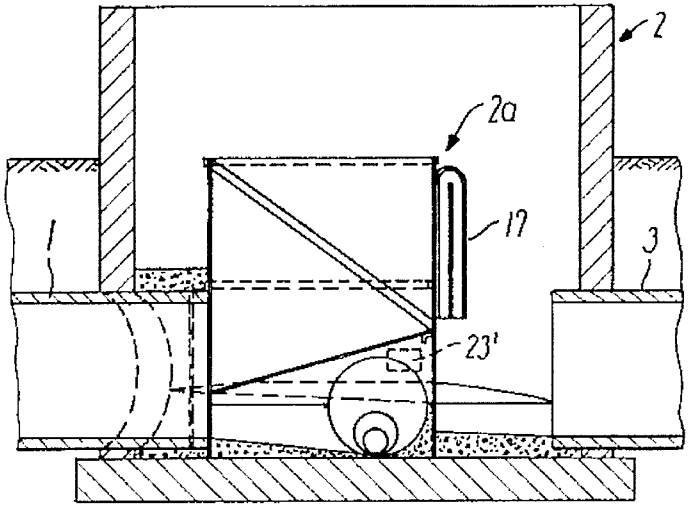
Figure 11:
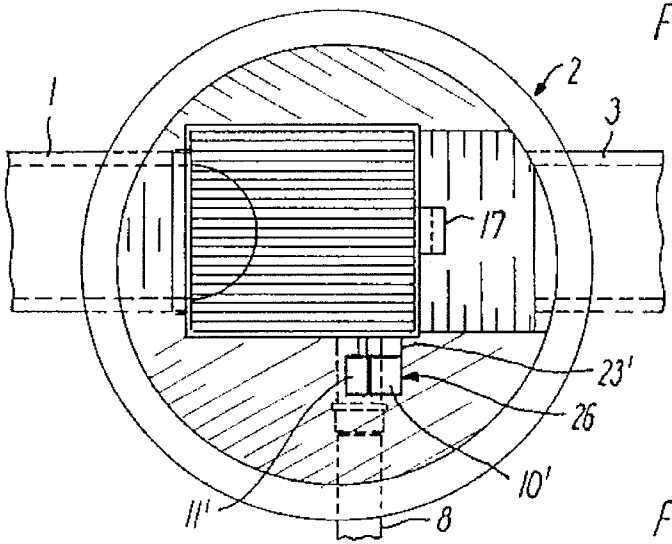

In FIGS. 7 and 8 an embodiment of the invention is shown, in which the underflow chamber is divided by means of an additional partition wall 20, in such a way that the underflow chamber is divided into a proper underflow chamber 7 and an under-overflow chamber 21, from which the under-overflow pipe 23 extends. In this embodiment the siphon system 17 is further provided with outlets to a particular chamber at the control unit 2*a* , from where an outlet 22 extends. In this case a possibility could be to prolong the delivery side of the siphon system 17 down to the lower edge of the foam screen 14 in order to replace it. Thereby, liquids like oil and grease may be caught by leading the flow through the siphon discharge pipe 22 to an oil or grease separator. In FIG. 8 the partition wall 5 is shown with a concave front edge 25. Hereby is achieved that the liquid flowing in is divided with a concave profile corresponding to the concentration profile as explained by way of introduction.

The individual details may be combined in different ways according to actual needs.

Generally, the concentrator works in the following way:

In dry weather, which is approx. 94% of the time seen over a year, the dry weather flow, which comprises sewage, infiltration, and possible drain water, flows through the system and directly to the purifying plant.

In case of rain the flow increases and if the flow becomes bigger than the discharge, a damming is created in the distribution and control unit 2*a* and up through the delivery pipe 1, which is by and by filled up until the over-fall edge 4*a*, the siphon system 17 or the under-overflow 11; 19 are reached.

Rain, which does not occasion overflow, is uninteresting in this connection, because the whole amount of water still passes through the purifying plant.

In view of rain occasioning overflow, the under-overflow can be adjusted as to capacity and time of start so that it starts when the capacity of the outlet and the overflow in combination surpasses the capacity of the delivery pipe as concentrator in such a way that the reduced concentrator effect is compensated for by an increased underflow.

If the control unit 2*a* is provided with a siphon system 17, where the capacity of the outlet and the siphon system in combination corresponds to the capacity of the delivery pipe as concentrator, the under-overflow can be adjusted as to height in such a way that it starts simultaneously with the overflow, the reduced concentrator effect being thus compensated for.

If the delivery pipe is comparatively small and with a comparatively heavy fall, so that the volume is limited within an acceptable damming height, the under-overflow can be set for start, before the overflow and the siphon system starts functioning.

FIGS. 9–12 show an embodiment, in which the chamber 4 is rectangular instead of circular. An under-overflow is provided here as something in between the under-overflows in the embodiments according to FIGS. 1–2 and FIGS. 5–6, respectively: a vertical pipe 26 next to the chamber 4 is divided into two ducts for forming an ascension pipe 10' and an under-overflow pipe 11', respectively, the ascension pipe 10' being connected with the chamber 4 through a short pipe 23' and the under-overflow pipe 11' discharging into the cutoff pipe 8.

Figure 13:
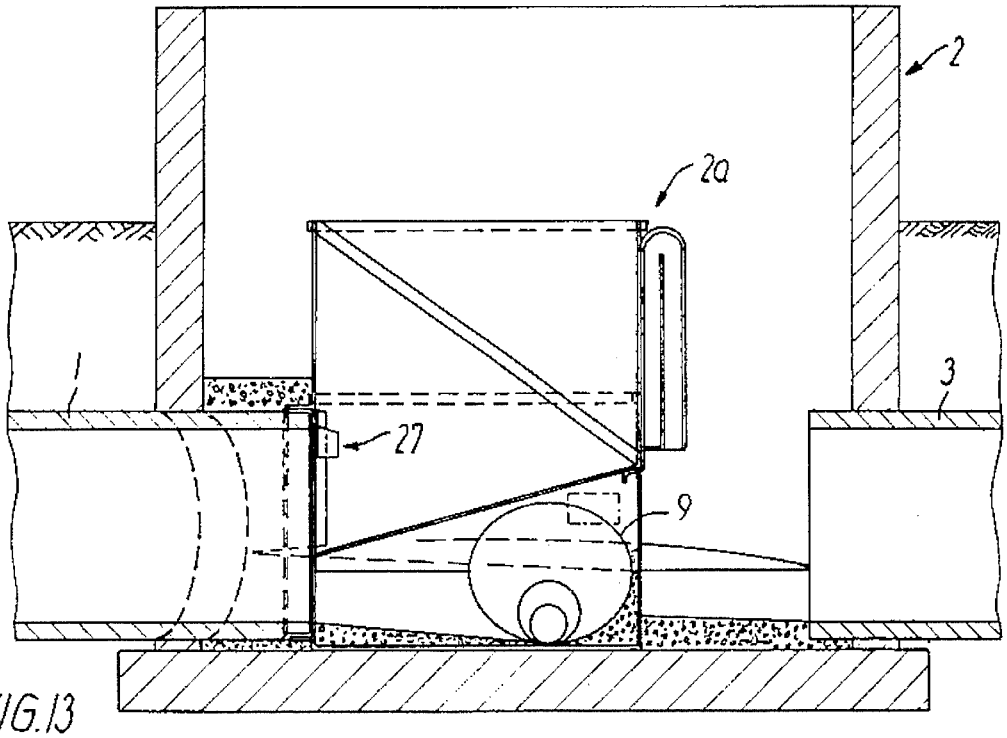
Figure 14:
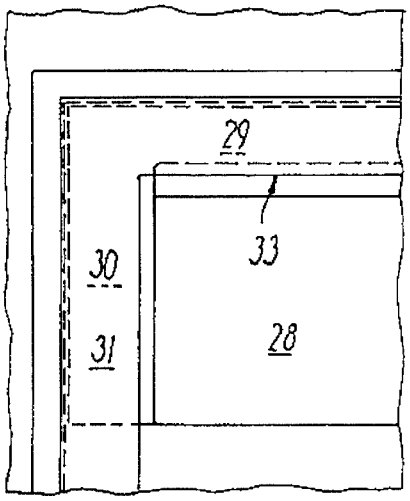
Figure 15:
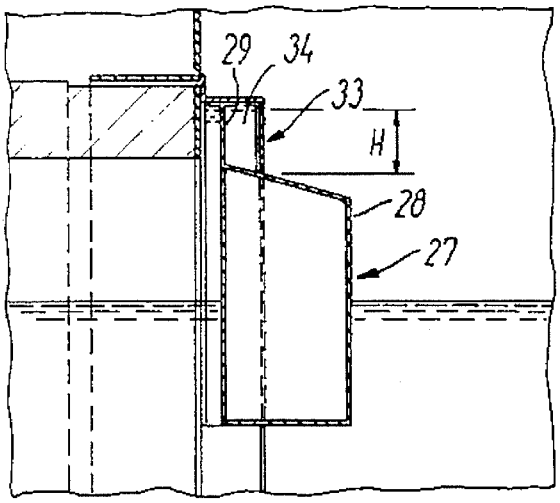
Figure 16:
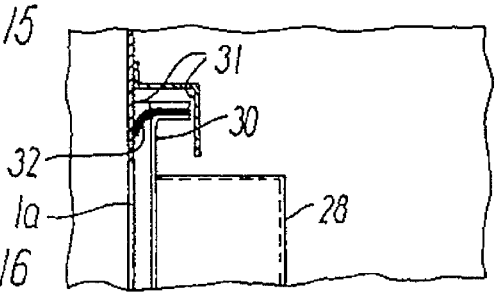

FIG. 13 shows the embodiment according to FIGS. 9–12, in which a movable foam screen is provided at the inlet 1*a* in form of a containment boom 27 in order at all events to keep back light impurities. The inlet 1*a* has in this case a rectangular cross section to make the construction of the containment boom 27 as simple as possible. As will be seen from FIGS. 10–12 the containment boom comprises a substantially box-shaped body 28, the top and the sides of which are provided with coherent fins 29, 30 for sealing purposes. The fins 30 of the sides are guided in guideways 31 and are sealed against them by means of lip sealings 32 of oilresistent rubber or the like. At the upper side of the inlet a hold is provided in form of a downwards opening duct 33 for reception of the upper fin 29. When the water level at the inlet 1*a* is low, the containment boom 27 floats on the water, as it is guided by the guideways 31 and it will retain the upper layers of water and consequently light impurities floating on the water. The lip sealings 32 will prevent the upper layers of water from flowing around the containment boom 27. When the cross section of the inlet 1*a* is full of water, the containment boom will be lifted to the position shown in FIGS. 14–16. The upper fin 29 is received in the duct 33 and an air pocket 34 is formed, said pocket acting as a plug and preventing the upper layers of water in the delivery pipe 1 from flowing over the containment boom 27, when water is rising in the chamber 4 against the over-fall edge 4*a*. The air pocket 34 just need to have a sufficient height H to prevent air from being let out due to pressure drop in the flow on account of the containment boom 27.

I claim:

1. A distribution and control unit comprising:

a chamber including an inlet (1*a*) and at least two subchambers including a lowermost subchamber and an uppermost subchamber;

at least one substantially impervious partition wall (5) disposed within the chamber for separating the subchambers one from another;

the partition wall including a partition wall edge disposed at the inlet for dividing a flow of water from the inlet into at least two layers at different respective levels;

a lowermost one of the levels communicating with the lowermost subchamber (7);

an uppermost one of the levels communicating with the uppermost subchamber (6);

the uppermost subchamber including an overfall edge (4*a*); and the lowermost subchamber including an underflow (8).

2. The distribution and control unit according to claim 1, wherein, from one of the subchambers (7; 21) of the chamber (4) next to the uppermost subchamber, a connection is provided to an overflow (11; 18) with an overflow edge (19) at the same height or lower than the overfall edge (4*a*), said overflow being connected via the overflow edge to the underflow (8).

3. The distribution and control unit according to claim 2, wherein respective heights of at least one of the overall edge (4*a*) and the overflow edge (19) are adjustable.

4. The distribution and control unit according to claim 2, wherein the overflow (18) is connected with a reservoir (16) comprising an outlet lower than the overflow edge and connected through a non-return valve (17) with the chamber (4).

5. The distribution and control unit according to claim 2, wherein a tube (23) leads from said one of the subchambers (7; 21) of the chamber (4) next to the uppermost subchamber and said tube is connected with the overflow (18), which is placed outside the chamber.

6. The distribution and control unit according to claim 2, further comprising a second partition wall (20) dividing a lower layer of water from the inlet (1*a*) into a pair of layers and providing a corresponding division of the lower subchamber of the chamber into two separate sublevels; a lower sublevel comprising the underflow (8) and upper sublevel being connected with the overflow (18).

7. The distribution and control unit according to claim 1 comprising a delivery pipe (1), wherein the cross section of the delivery pipe at the inlet (1*a*) extends higher than the cross section of the inlet proper.

8. The distribution and control unit according to claim 1, including a siphon device (17) at the overfall edge (4*a*), said siphon device (17) including a siphon inlet inside the chamber and a discharge side outside the chamber, whereby the uppermost subchamber (5) of the chamber (4) is emptied at least partially after the overfall has been in function.

9. The distribution and control unit according to claim 8, wherein the discharge side of the siphon device (17) is connected to an outlet (22).

10. The distribution and control unit according to claim 9, wherein the siphon device is provided with siphon inlets at the upper part of the delivery pipe (1) at the inlet (1*a*) of the chamber (4).

11. The distribution and control unit according to claim 1, wherein at the inlet (1*a*) a containment boom (27) is provided, said boom extending transversely to the width of the inlet (1) and being adapted to follow a water level in the inlet (1*a*), and including hold means (33) for preventing a lower edge of the containment boom (27) from being lifted to an upper edge of the inlet (1*a*).

12. The distribution and control unit according to claim 1, wherein the inlet edge is curved.

* * * * *